US006434357B1

(12) United States Patent
Maul et al.

(10) Patent No.: US 6,434,357 B1
(45) **Date of Patent: *Aug. 13, 2002**

(54) OIL EXUDING ROLLER FOR AN ELECTROPHOTOGRAPHIC PRINTER, INCLUDING A METHOD FOR ITS FABRICATION, AND ITS FUNCTION ENCOMPASSED BY A METHOD FOR APPLYING A TONER REPELLING SUBSTANCE TO A FUSER ROLLER

(75) Inventors: Michael David Maul; Edward Alan Rush, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,771

(22) Filed: Dec. 13, 2000

(51) Int. Cl.[7] ..... G03G 15/20
(52) U.S. Cl. ..... 399/325
(58) Field of Search ..... 399/354, 325, 399/326

(56) References Cited

U.S. PATENT DOCUMENTS 3,964,431 A * 6/1976 Namiki ..... 399/325 X
5,030,976 A 7/1991 Salmon
5,274,428 A 12/1993 Wong et al.
5,482,552 A * 1/1996 Kikukawa et al. ..... 399/325 X
5,485,259 A * 1/1996 Uehara et al. ..... 399/325
5,788,770 A 8/1998 Hobson et al.
5,853,832 A * 12/1998 Ishikawa ..... 399/325 X
6,195,526 B1 * 2/2001 Lee et al. ..... 399/325 X
6,212,355 B1 * 4/2001 Bunn et al. ..... 399/325
6,266,509 B1 * 7/2001 Ota et al. ..... 399/325

FOREIGN PATENT DOCUMENTS

JP 62-44754 * 2/1987
JP 4-139477 * 5/1992

* cited by examiner

*Primary Examiner*—Fred L Braun
(74) *Attorney, Agent, or Firm*—Kilpatrick Stockton, LLP

(57) ABSTRACT

An oil supply roller for an electrophotographic printer fuser allows silicone oil to exude from the oil supply roller onto the surface of the fuser hot roller in a controlled fashion to prevent toner from adhering to the fuser hot roller, and also serves to provide a smooth toner surface. A metering layer disposed on an outer surface of the roller provides an even, controlled flow of oil to the surface of the roller. Further, a buffer layer may be employed to decrease the overall volume of the oil bearing layer to decrease the effects of swelling in that layer. Therefore, a precisely metered supply of oil is provided to the fuser hot roller while reducing complexity and moving parts. A method for fabricating the fuser hot roller by impregnating silicone rubber with a toner repelling substance and disposing the impregnated rubber about a rotatable drive shaft is also provided.

33 Claims, 2 Drawing Sheets

OIL EXUDING ROLLER FOR AN ELECTROPHOTOGRAPHIC PRINTER, INCLUDING A METHOD FOR ITS FABRICATION, AND ITS FUNCTION ENCOMPASSED BY A METHOD FOR APPLYING A TONER REPELLING SUBSTANCE TO A FUSER ROLLER

BACKGROUND OF THE INVENTION

Electrophotographic processes such as that used in printers, copiers, and fax machines produce hardcopy images on a print media such as paper through precise deposition of toner onto the print media. The toner is applied by the print mechanism to correspond to the desired text or image to be produced. Such toner is then permanently affixed to the media by a fuser, which heats the toner such that it melts and bonds to the print media.

Typically the fuser mechanism comprises at least two contiguous rollers, a hot roller and a backup roller. The media is transported to the print mechanism and passes between the contiguous rollers, such that fuser hot roller heats the media to melt and fuse the toner to the print media.

As the toner melts, it becomes tacky and has a tendency to adhere to the fuser hot roller. Over time, toner accumulates on the hot roller, and eventually on the backup roller, causing degradation of the image quality on the print media.

Application of a lubricating substance to the surface of the fuser hot roller serves to weaken the bond between the toner and the hot roller and prevents accumulation of toner on the hot roller, and also serves to smooth the toner surface. Silicone oil is one such lubricating substance which has effective toner repelling properties. Alternatively, such oil can be applied to the backup roller, and then transferred to the fuser hot roller due to rotational association of the backup roller or other fuser roller with the fuser hot roller.

There are a variety of prior art oil delivery systems to apply silicone oil to the fuser hot roller. Oil webs, oil wicking systems, and oil delivery rolls have been employed to provide a controlled supply of oil to the hot roller. Such prior art mechanisms, however, increase the complexity of the system by adding moving parts, and increase maintenance because of the need to maintain a supply of silicone oil. Further, as such oil delivery systems tend to promote a continuous oil flow, an idle period between printing cycles can result in a surge of oil, called an oil dump, during a successive print phase. Such oil dumps can compromise the finished print quality, and further can damage the printer if excess oil leaks onto other components.

One prior art oil delivery system is shown in FIG. 1, in which an oil web 10 extends from a web supply roller 14 to a web take-up roller 12. The web is generally a fabric material of one or more layers and is held in contact with the fuser hot roller 18 by one or more biasing rollers 16. Oil delivery is controlled by indexing the web 10 by controlled rotation of the take-up and supply rolls 12 and 14. While effective at delivering oil, such an oil delivery system generally increases the number of moving parts, affecting cost and maintenance.

Another prior art oil delivery system is shown in FIG. 2, which utilizes a wicking element 20 biased against the fuser hot roller 18 by a spring loaded or other biasing member 22 mounted on a support 23, or otherwise disposed in contact with the fuser hot roller. The wicking element is a piece of fibrous textile or mesh material adapted to transport silicone oil through capillary action. As the wicking element extends from an oil reservoir 24 to the hot roller 18, the wicking element is therefore adapted to deliver silicone oil along the length of the fuser hot roller 18. Such a system, however, tends to be prone to oil dumps due to the capillary characteristic of the wicking element material, and further requires a separate oil reservoir 24 to be maintained.

FIGS. 3*a* and 3*b* show prior art oil delivery rolls. Such rolls utilize an outer metering layer wrapped around an oil containing center. FIG. 3*a* shows a web wrapped roller 34, which includes an oil saturated wrapping 30 such as a temperature resistant paper or non-woven material around a support shaft 36. An outer metering layer 38, such as felt or a metering membrane, is wrapped around the oil saturated wrapping to limit the flow of oil brought to the surface by the capillary action of the oil saturated wrapping. FIG. 3*b* shows a tank-type oil roller which uses a hollow support shaft 44 as an oil reservoir. The hollow support shaft has oil delivery holes 46 along the length for delivering oil to a metering material 42, such as rolled fabric, which is wrapped around the hollow support shaft 44. Each of these oil delivery rolls shown in FIGS. 3*a* and 3*b* rotationally engage the fuser hot roller for the purpose of applying oil. Such an oil delivery roll, however, requires periodic replenishment of the oil reservoir and can also result in oil dumps if the oil delivery roller remains in contact with the fuser hot roller during idle periods.

An oil supply roller for an electrophotographic printer fuser allows silicone oil to exude from the oil supply roller onto the surface of the fuser hot roller to prevent toner from adhering to the fuser hot roller. Such an oil supply roller provides oil delivery to the fuser hot roller surface without the need for a separate oil reservoir and delivery system. The oil supply roller decreases the potential for large surges of oil onto the print media, while continuing to provide a controlled delivery of oil to the fuser hot roller.

Such an oil exuding cylindrical roller element is formed from silicone rubber or other material adapted to exude a toner repelling substance such as silicone oil. The toner repelling substance exudes from the cylindrical roller element onto a fuser surface, such as a surface of the fuser hot roller or other roller in rotational association with the fuser hot roller.

It would be beneficial, therefore, to develop an oil delivery system which reduces the number and complexity of moving parts, avoids the maintenance of an oil reservoir, and which avoids the tendency for oil dumps, while still providing a carefully metered supply of oil to the fuser hot roller.

The exuding rate of the oil from the cylindrical roller element to the surface of fuser hot roller is affected primarily by the viscosity of the silicone oil and the rotational speed of the rollers. The viscosity of the oil tends to decrease with increased temperature. Accordingly, the silicone oil impregnated in the roller is selected to be of a viscosity which exudes at a desired flow rate at the operating temperature of the fuser hot roller. A greater flow rate can be achieved by decreasing the viscosity of the silicone oil selected. Further, as the fuser hot roller generally cools during idle periods, the oil viscosity increases and therefore flows less freely; thus, if the oil supply roller is embodied in the backup roller, the oil supply roller can remain in contact with the fuser hot roller for extended idle periods without increasing the potential for oil dumps.

As the exuding rate of the silicone oil is most affected by the viscosity of the oil, a larger quantity of impregnated silicone oil does not substantially increase the flow of oil. Therefore, the flow rate tends to remain consistent regardless of the quantity of oil remaining impregnated in the roller. Accordingly, a large quantity of oil can be impregnated in the silicone rubber, thereby increasing longevity of the oil impregnated roller without affecting the flow rate or increasing the potential for oil dumps.

BRIEF SUMMARY OF THE INVENTION

An oil exuding roller comprised of a plurality of layers, one of which is comprised of a homogenous, oil-secreting substance. A metering membrane layer, such as polytetrafluorethylene (PTFE), felt, or paper, may be wrapped around the cylindrical roller element to further limit and control the amount of oil exuded. Also, the oil exuding cylindrical roller element may be disposed around an inner silicone rubber layer or other inner buffer layer to minimize swelling, since the oil exuding portion may have a tendency to swell, depending on the type of oil used, the type of rubber used, or the operating temperature. Finally, a barrier layer such as VITON® may be provided between the inner buffer layer and the oil exuding cylindrical roller element to minimize diffusion of the silicone oil into the inner buffer layer.

The oil exuding cylindrical roller element may be embodied within the hot roller itself, such that toner repelling substance is provided to the surface of the hot roller from within. Alternatively the oil exuding cylindrical roller element is embodied within the backup roller, such that the toner repelling substance is provided from the backup roller to the surface of the hot roller. Further still, both the hot roller and the backup roller may comprise an oil exuding cylindrical roller element.

A cleaning element such as a cleaner roller, wiper, web, or scraper can be provided in contact with the hot roller or a roller engaged directly or indirectly therewith to remove excess toner, dust or other particles which may accumulate on the roller surfaces.

BRIEF DESCRIPTION OF THE SEVERAL VIEWS OF THE DRAWING

The invention as disclosed herein will be more fully understood by the following detailed description and drawings, of which.

DETAILED DESCRIPTION OF THE INVENTION

Figure 5:
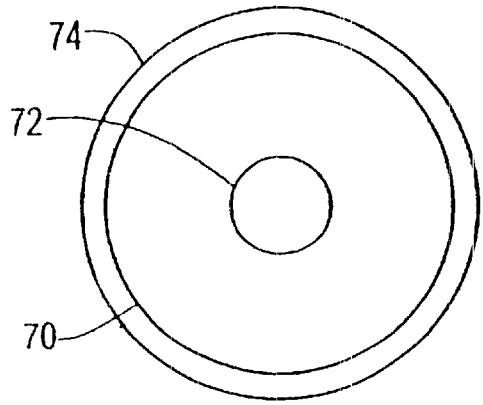
FIG. 5 shows an oil exuding roller having a metering layer as defined by the present invention.

Referring to FIG. 5, a cylindrical roller element 70 comprised of an oil exuding substance such as silicone rubber is disposed around a support shaft 72 such as by frictional fitting or adhesive. A preferred oil exuding substance is an oil impregnated rubber sold by Dow Corning under the Trademark Silastic S50508-Oil Exuding Grade. The oil impregnated silicone rubber is typically formed by impregnating the silicone rubber with oil during the manufacturing process. A metering layer 74, such as expanded PTFE or other suitable metering membrane, is wrapped around a cylindrical roller element 70 to control the exuding rate of the silicone oil and improve the uniformity of silicone oil coverage.

As mentioned above, the secretion rate of the oil is affected primarily by the viscosity of the oil. As the viscosity of the oil varies with temperature, such oil is selected for the viscosity at the normal operating temperature of the fuser hot roller. Secretion flow rates for several oil exuding rubber materials under different operating conditions are shown in Table 1.

TABLE 1

| Sample | % Quantity Impregnated | Average Per Page | After 30 Min. Idle | After Idle Overnight |
|---|---|---|---|---|
| 1 | 2% | 0.1475 mg | 0.05 mg | 0.1 mg |
| 2 | 18% | 0.182 mg | 0.76 mg | 0.55 mg |
| 3 | 2% | 0.168 mg | 0.55 mg | 0.69 mg |

Quantity Impregnated refers to the percentage of the roller which is impregnated oil. Average Per Page refers am to the quantity of oil deposited onto a sheet during normal operation at a normal fuser operating temperature. After 30 Min. Idle refers to the first page following such an idle cycle. After Idle Overnight refers to the first page following an overnight idle period, typically expected to be about 15 hours. The quantity of oil secreted should be less than 1.0 mg per page to reduce the potential for duplex defects from excessive oil in the electrophotographic process. Further, the print media begins to have a moist appearance when the oil quantity approaches the range of 5.0 mg–10.0 mg per page, depending on the toner used.

The quantity of oil impregnated in the silicone rubber, rather than the secretion rate, tends to affect the longevity of the oil impregnated roller. Accordingly, the secretion rate tends to remain consistent until the quantity of oil remaining impregnated in the oil impregnated roller decreases past a minimum threshold, at which point substantially all the impregnated oil has been secreted. One advantage provided by the fact that viscosity, rather than quantity, tends to drive the secretion rate is that since the fuser cools during idle periods, the viscosity of the oil increases during these periods, resulting in a reduced secretion rate. Even after an overnight idle period, the quantity of oil secreted is small enough to allow the oil impregnated roller to remain in rotational engagement without compromising print quality through oil dumps. Accordingly, no retraction mechanism to disengage the oil impregnated roller is required.

Figure 6:
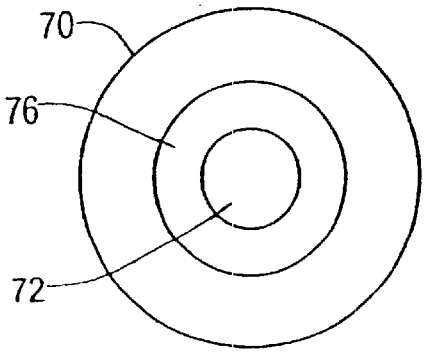
FIG. 6 shows an oil exuding roller having an inner buffer layer as defined by the present invention.

As the silicone oil or other toner repelling substance impregnated in the cylindrical roller element 70 may have a tendency to cause the roller element to swell, precise spacing tolerances and tensions within the fuser mechanism can be affected. Accordingly, FIG. 6 shows another embodiment of an improved oil exuding roller in which an inner buffer layer 76 is disposed around the support shaft 72. The cylindrical roller element 70 is then formed by providing a coating of oil exuding silicone rubber around the inner buffer layer 76. In this manner, the volume of the oil exuding roller which comprises the oil exuding cylindrical roller element is thereby reduced to minimize the opportunity for swelling.

Figure 7:
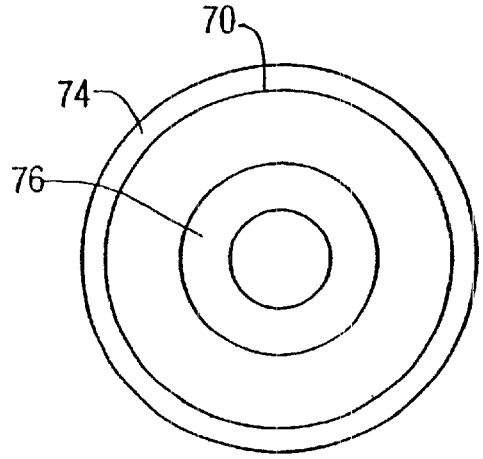
FIG. 7 shows an oil exuding roller having an inner buffer layer and a metering layer as defined by the present invention.
Figure 8:
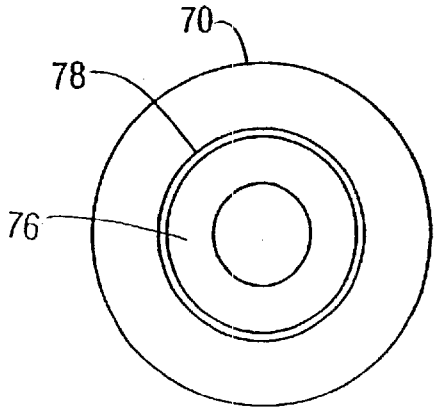
FIG. 8 shows an oil exuding roller having an inner buffer layer and a barrier layer as defined by the present invention.
Figure 9:
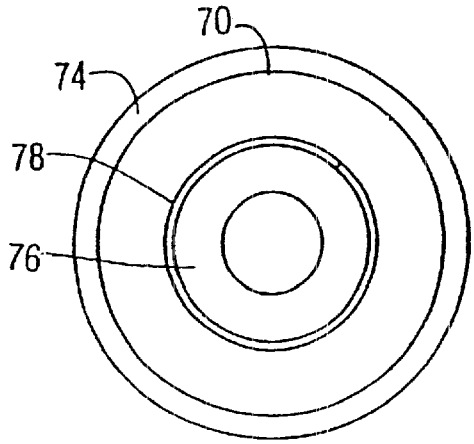
FIG. 9 shows an oil exuding roller having an inner buffer layer, barrier layer, and metering layer.

FIG. 7 introduces another embodiment of an improved oil exuding roller comprising both the metering layer 74 and the inner buffer layer 76. However, as the inner buffer layer 76 may be comprised of a substance similar to that of the cylindrical roller element 70, at least in one embodiment, diffusion of silicone oil from the oil exuding cylindrical roller element 70 into the inner buffer layer 76 may occur. A barrier layer 78 may therefore be employed between the inner buffer layer 76 and the cylindrical roller element 70, as shown in FIGS. 8 and 9, to prevent inward diffusion and further minimize swelling of the oil exuding roller. Such a barrier layer may be employed alone (FIG. 8), or with the metering layer 74 (FIG. 9). In an embodiment in which the buffer layer 76 is not porous or absorbent, the barrier layer 78 may be unnecessary.

Figure 1:
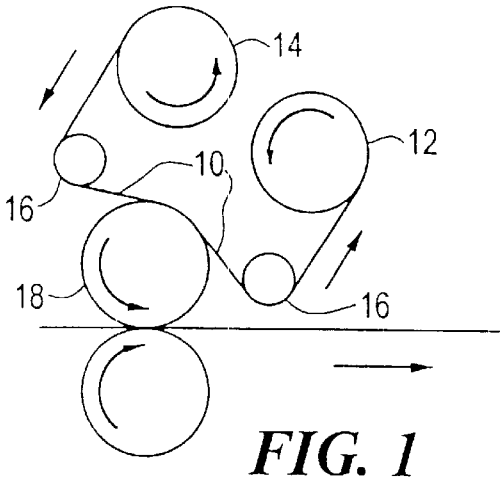
FIG. 1 PRIOR ART
FIG. 1 shows a prior art oil web system.
Figure 2:
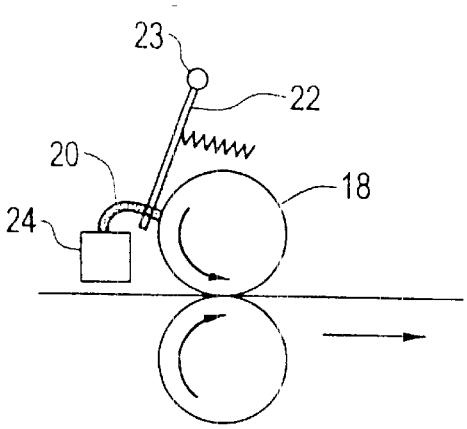
FIG. 2 PRIOR ART
FIG. 2 shows a prior art oil wicking system.
Figure 3A:
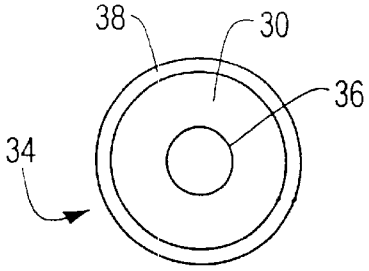
FIG. 3a PRIOR ART
FIG. 3*a* shows a web wrap type of oil delivery roll.
Figure 3B:
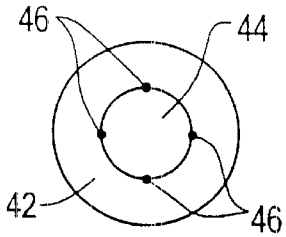
FIG. 3b PRIOR ART
FIG. 3*b* shows an oil reservoir type of oil delivery roll.
Figure 4A:
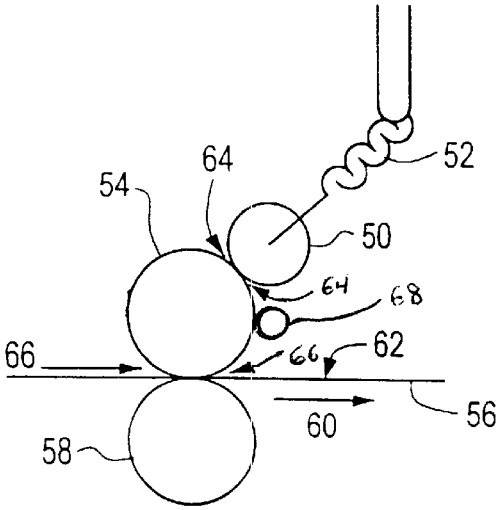
FIG. 4*a* shows an oil delivery system as defined by the present invention.
Figure 4B:
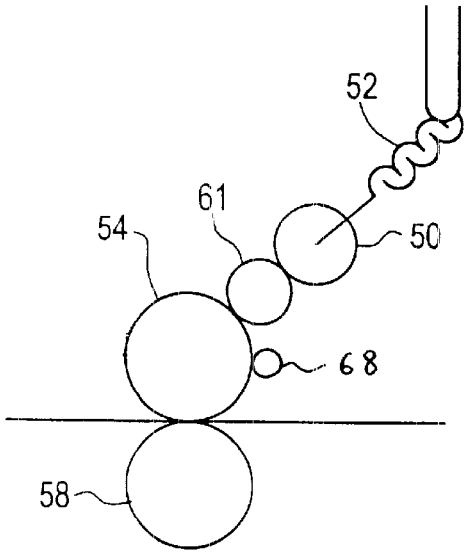
FIG. 4*b* shows an oil delivery system as defined by the present invention utilizing an indirect donor roll.

The oil exuding roller having a metering layer, buffer layer, or both, as defined by the present invention may have a variety of rotational associations with other fuser surfaces, such as rollers and print media. Such association may be direct rotational association with the fuser hot roller, indirect association through a donor roller, or the oil exuding roller may itself also be the fuser hot roller or fuser backup roller. Referring to FIGS. 4*a* and 4*b*, oil delivery systems utilizing direct and indirect oil exuding roller association, respectively, as defined herein are shown. (For simplicity of illustration, the metering layer 74, buffer layer 76 and barrier layer 78 according to the present invention are not shown in these figures.) The oil exuding roller 50 is rotatably mounted on a resilient mounting 52 in rotational association with the fuser hot roller 54. Resilient mounting 52 is biased to keep the oil exuding roller 50 against the fuser hot roller 54 and to maintain rotational association therewith.

Fuser hot roller 54 is rotated to advance print media 56, disposed between the fuser hot roller and a fuser backup roller 58, in the direction shown by media path 60 via frictional contact with the fuser hot roller. Alternatively, print media could be advanced by alternate drive mechanisms, such as conveyor belts or trays. Toner deposited on a media surface 62 of the print media 56 is then melted and fused by the fuser hot roller 54 as the print media 56 passes in contact therewith.

As fuser hot roller 54 is rotated in contact with the oil exuding roller 50, silicone oil or other toner repelling substance is secreted from the oil exuding roller onto the fuser hot roller at an oil secretion point 64. As the fuser hot roller continues to rotate with the oil, such oil tends to prevent melted toner residue and unfused toner from adhering to the fuser hot roller as it contacts the print media 56 at a toner fuser position 66, and also serves to provide a smooth toner surface on the print media. Accordingly, accumulation of unused toner on the fuser hot roller is prevented.

A cleaner roller 68, in rotational communication with fuser hot roller 54, may be used to eliminate accumulation of unfused toner and dust on the fuser hot roller. As small amounts of unfused toner and extraneous matter such as dust may adhere to the fuser hot roller, cleaner roller 68 absorbs such matter. Cleaner roller 68 is typically comprised of a fibrous or mesh textile substance. As silicone oil serves to weaken the bond between toner and the fuser hot roller, this excess toner is easily absorbed by cleaner roller 68.

Alternatively, cleaner roller 68 may also be implemented as a wiper, scraper, or web, as long as a fibrous or abrasive surface adapted to remove extraneous matter is brought in contact with the fuser hot roller. Further, such contact may be direct or indirect, as the cleaner roller may be located in contact with other rollers, as long as such a cleaner roller is in direct or indirect rotational communication with the fuser hot roller.

FIG. 4*b* shows a similar roller orientation using a donor roller. The donor roller 61 is disposed between and in rotational association with both the oil exuding roller 50 and the fuser hot roller 54. Oil is therefore secreted from the oil roller 50 onto the donor roller 61, and subsequently applied to the fuser hot roller 54. Such a donor roller can serve to allow optimal oil roller placement for maintenance service access. Other embodiments employ direct and indirect application of oil to the fuser hot roller 54 through various roller arrangements. Various support structures and motors for the rollers are known to those skilled in the art. Such alternate applications are effective at providing a controlled quantity of oil to the fuser hot roller as long as the oil exuding roller is in rotational association with the fuser hot roller.

Figure 4C:
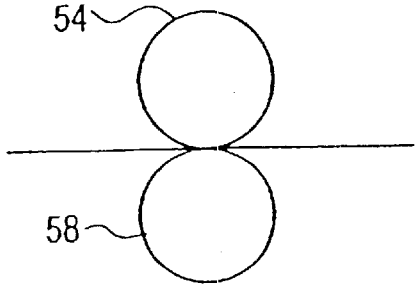
FIG. 4*c* shows an oil exuding roller used as a hot roller and a backup roller.

As shown in FIG. 4*c*, the oil exuding roller may also be the fuser hot roller 54 or the fuser backup roller 58, land, alternatively, both the fuser hot roller and the fuser backup roller can be oil exuding rollers. In these embodiments, the viscosity characteristics of the silicone oil may be elected in view of the potentially greater operating temperature of the hot roller.

The various embodiments disclosed herein can be employed as an oil exuding roller 50, as a fuser hot roller 54, or as a fuser backup roller 58 (FIGS. 4*a*–4*c*), either alone or in combination. Further, as various extensions and modifications to the embodiments disclosed herein may be apparent to those skilled in the art, particularly with regard to alternate arrangements of rollers, the present invention is not intended to be limited except by the following claims.

What is claimed is:

1. A fuser supply roller for a fuser assembly of an electrophotographic process comprising:

a rotatable drive shaft;

a supply layer, impregnated with a toner repelling substance, concentrically disposed about said rotatable drive shaft; and a metering layer disposed about said supply layer, said metering layer adapted for providing controlled transfer of said toner repelling substance from said supply layer onto a fuser surface, wherein said fuser supply roller comprises at least one of a fuser hot roller and a fuser backup roller.

2. The fuser supply roller of claim 1 wherein said fuser supply roller comprises said fuser backup roller and said fuser surface is that of a fuser hot roller in rotational association with said fuser supply roller.

3. The fuser supply roller of claim 1 wherein said fuser supply roller comprises said fuser hot roller and said fuser surface is that of said fuser supply roller.

4. The fuser supply roller of claim 1 wherein said toner repelling substance is silicone oil.

5. The fuser supply roller of claim 1 wherein said metering layer is PTFE.

6. The fuser supply roller of claim 1 further comprising an inner buffer layer disposed between said rotatable drive shaft and said supply layer.

7. The fuser supply roller of claim 6 further comprising a barrier layer between said inner buffer layer and said supply layer, wherein said barrier layer is impervious to said toner repelling substance.

8. The fuser supply roller of claim 1 wherein said electrophotographic process is implemented in an apparatus selected from the group consisting of a printer, a copier, and a fax machine.

9. A fuser supply roller for a fuser assembly of an electrophotographic process comprising:

a rotatable drive shaft;

a supply layer, impregnated with a toner repelling substance, concentrically disposed about said rotatable drive shaft, said supply layer adapted for providing controlled transfer of said toner repelling substance from said supply layer onto a fuser surface; and a buffer layer disposed intermediate said supply layer and said rotatable drive shaft, said buffer layer adapted for reducing the volume of said supply layer as a percentage of said fuser supply roller, wherein said fuser supply roller comprises at least one of a fuser hot roller and a fuser backup roller.

10. The fuser supply roller of claim 9 wherein said fuser supply roller comprises said fuser backup roller and said fuser surface is that of a fuser hot roller in rotational association with said fuser supply roller.

11. The fuser supply roller of claim 9 wherein said fuser supply roller comprises said fuser hot roller and said fuser surface is that of said fuser supply roller.

12. The fuser supply roller of claim 9 wherein said toner repelling substance is silicone oil.

13. The fuser supply roller of claim 9 further comprising a metering layer disposed about said supply layer and adapted for providing controlled transfer of said toner repelling substance from said supply layer onto said fuser surface.

14. The fuser supply roller of claim 13 wherein said metering layer is PTFE.

15. The fuser supply roller of claim 9 further comprising a barrier layer between said buffer layer and said supply layer, wherein said barrier layer is impervious to said toner repelling substance.

16. The fuser supply roller of claim 9 wherein said electrophotographic process is implemented in an apparatus selected from the group consisting of a printer, a copier, and a fax machine.

17. A toner fuser apparatus for an electrophotographic printer comprising:

a fuser oil supply roller having a fuser roller surface in rotational association with a fuser hot roller, wherein said fuser oil supply roller further comprises:

a rotatable drive shaft; and a liquid-bearing layer concentrically disposed about said rotatable drive shaft, said liquid-bearing layer impregnated with a toner repelling substance; and a metering layer disposed about said liquid-bearing layer and adapted for controlled secretion of said toner repelling substance upon said association with said fuser hot roller, wherein said rotatable drive shaft is operable to provide said rotational association of said fuser oil supply roller with said fuser hot roller, wherein said toner repelling substance is substantially uniformly distributed throughout said liquid-bearing layer such that said toner repelling substance is exuded onto said fuser roller surface at a substantially constant, predetermined rate, and wherein said fuser oil supply roller comprises a fuser backup roller.

18. A toner fuser apparatus for an electrophotographic printer comprising:

a fuser oil supply roller having a fuser roller surface in rotational association with a fuser hot roller, wherein said fuser oil supply roller further comprises:

a rotatable drive shaft; and a liquid-bearing layer concentrically disposed about said rotatable drive shaft, said liquid-bearing layer impregnated with a toner repelling substance and adapted for controlled secretion of said toner repelling substance upon said association with said fuser hot roller; and a buffer layer disposed intermediate said liquid-bearing layer and said rotatable drive shaft and adapted for reducing the volume of said liquid-bearing layer as a percentage of said fuser oil supply roller volume, wherein said rotatable drive shaft is operable to provide said rotational association of said fuser oil supply roller with said fuser hot roller, wherein said toner repelling substance is substantially uniformly distributed throughout said liquid-bearing layer such that said toner repelling substance is exuded onto said fuser roller surface at a substantially constant, predetermined rate, and wherein said fuser oil supply roller comprises a fuser backup roller.

19. The toner fuser apparatus of claim 18 wherein said fuser oil supply roller further comprises a barrier layer disposed intermediate said liquid-bearing layer and said buffer layer, said barrier layer being substantially impervious to said toner repelling substance.

20. A toner fuser apparatus for an electrophotographic printer comprising:

a backup roller; and a fuser hot roller adapted for fusing toner onto print media passing between said backup roller and said fuser hot roller, wherein said fuser hot roller comprises a rotatable drive shaft, a liquid-bearing layer concentrically disposed about said rotatable drive shaft, said liquid-bearing layer impregnated with a toner repelling substance, and a metering layer adapted for controlled secretion of said toner repelling substance onto an external surface of said fuser hot roller.

21. A toner fuser apparatus for an electrophotographic printer comprising:

a backup roller; and a fuser hot roller adapted for fusing toner onto print media passing between said backup roller and said fuser hot roller, wherein said fuser hot roller comprises a rotatable drive shaft, a buffer layer concentrically disposed about said rotatable drive shaft, and a liquid-bearing layer concentrically disposed about said buffer layer, said liquid-bearing layer impregnated with a toner repelling substance and adapted for controlled secretion of said toner repelling substance onto an external surface of said fuser hot roller.

22. The apparatus of claim 21 further comprising a metering layer for providing a controlled release of said toner repelling substance onto said external surface of said fuser hot roller.

23. A method of applying a toner repelling substance to a fuser roller comprising the steps of:

impregnating silicone rubber with said toner repelling substance to form an exuding layer, wherein said impregnated silicone rubber is adapted for exuding said toner repelling substance;

providing a rotatable drive shaft;

disposing said exuding layer about said rotatable drive shaft;

disposing a metering layer about said exuding layer to form an impregnated roller;

disposing said impregnated roller in rotational association with a fuser hot roller; and rotating said oil impregnated roller in coordination with rotation of said fuser hot roller such that said toner repelling substance is exuded from said impregnated roller onto said fuser roller surface.

24. The method of claim 23 wherein said step of disposing said impregnated roller comprises disposing said impregnated roller as a fuser backup roller in rotational association with said fuser hot roller.

25. The method of claim 23 wherein said step of impregnating comprises impregnating said silicone rubber with silicone oil as said toner repelling substance.

26. A method of applying a toner repelling substance to a fuser roller comprising the steps of:

impregnating silicone rubber with said toner repelling substance to form an exuding layer, wherein said impregnated silicone rubber is adapted for exuding said toner repelling substance;

providing a rotatable drive shaft;

disposing a buffer layer about said rotatable drive shaft;

disposing said exuding layer about said buffer layer to form an impregnated roller;

disposing said impregnated roller in rotational association with a fuser hot roller; and rotating said oil impregnated roller in coordination with rotation of said fuser hot roller such that said toner repelling substance is exuded from said impregnated roller onto said fuser roller surface.

27. The method of claim 26 wherein said step of disposing said impregnated roller comprises disposing said impregnated roller as a fuser backup roller in rotational association with said fuser hot roller.

28. The method of claim 26 wherein said step of impregnating comprises impregnating said silicone rubber with silicone oil as said toner repelling substance.

29. The method of claim 26 further comprising the step of disposing a barrier layer, impervious to said toner repelling substance, intermediate said buffer layer and said exuding layer.

30. The method of claim 26 further comprising the step of disposing a metering layer about said exuding layer for controlled release of said toner repelling substance from said impregnated roller.

31. A method of fabricating a fuser hot roller comprising the steps of:

impregnating silicone rubber with a toner repelling substance to form an oil exuding layer, wherein said toner repelling substance is adapted to be exuded from said silicone rubber;

providing a rotatable drive shaft adapted to radiate heat;

disposing said oil exuding layer about said rotatable drive shaft; and forming an oil impregnated fuser hot roller by disposing a metering layer about said oil exuding layer for controlled release of said toner repelling substance.

32. A method of fabricating a fuser hot roller comprising the steps of:

impregnating silicone rubber with a toner repelling substance to form an oil exuding layer, wherein said toner repelling substance is adapted to be exuded from said silicone rubber;

providing a rotatable drive shaft adapted to radiate heat;

disposing a buffer layer about said rotatable drive shaft; and forming an oil impregnated fuser hot roller by disposing said oil exuding layer about said buffer layer.

33. The method of claim 32 further comprising the step of disposing a barrier layer impervious to said toner repelling substance intermediate said buffer layer and said oil exuding layer.

* * * * *